US010215413B2

(12) United States Patent
Purcell et al.

(10) Patent No.: US 10,215,413 B2
(45) Date of Patent: Feb. 26, 2019

(54) BUNDLED TUBE FUEL NOZZLE WITH VIBRATION DAMPING

(71) Applicant: General Electric Company, Schenectady, NY (US)

(72) Inventors: Timothy James Purcell, Greenville, SC (US); Jeffrey Scott LeBegue, Simpsonville, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 15/070,000

(22) Filed: Mar. 15, 2016

(65) Prior Publication Data

US 2017/0268780 A1 Sep. 21, 2017

(51) Int. Cl.

| | |
|---|---|
| ***F02C 1/00*** | (2006.01) |
| ***F23R 3/28*** | (2006.01) |
| ***F01D 25/04*** | (2006.01) |
| ***F23D 14/78*** | (2006.01) |

(52) U.S. Cl.

CPC ..... *F23R 3/283* (2013.01); *F01D 25/04* (2013.01); *F23D 14/78* (2013.01); *F23R 3/286* (2013.01)

(58) Field of Classification Search

CPC ..... F01D 25/04; F23D 14/78; F23R 3/283; F23R 3/286

See application file for complete search history.

(56) References Cited

U.S. PATENT DOCUMENTS 3,204,682 A * 9/1965 Teleshefsky ..... F23D 14/38 239/424.5
3,291,190 A * 12/1966 Radley ..... F23D 14/10 239/394
3,777,502 A * 12/1973 Michie, III ..... F16L 9/18 137/340
4,756,685 A * 7/1988 Davies ..... F23D 14/22 239/132.3

(Continued)

FOREIGN PATENT DOCUMENTS

EP 0 198 332 A2 10/1986
EP 0198332 A2 * 10/1986 ..... F23D 14/22

OTHER PUBLICATIONS

Extended European Search Report and Opinion issued in connection with corresponding EP Application No. 17160048.9 dated Jul. 14, 2017.

*Primary Examiner* — Jesse S Bogue
(74) *Attorney, Agent, or Firm* — Dority & Manning, P.A.

(57) ABSTRACT

A bundled tube fuel nozzle includes a forward plate, an intermediate plate, an aft plate and an outer sleeve. The forward plate, the intermediate plate and the outer sleeve define a fuel plenum therebetween. An aft plate axially is spaced from the intermediate plate and the intermediate plate, the aft plate and the outer sleeve define a cooling air plenum. A plurality of tubes extends through the forward plate, the fuel plenum, the intermediate plate, the cooling air plenum and the aft plate. Each tube of the plurality of tubes extends through a respective tube opening defined by the aft plate. A radial gap is defined between an outer surface of each tube and an inner surface of the respective tube opening. The plurality of tubes comprises at least one tube that is radially loaded against the inner surface of the respective tube opening.

12 Claims, 3 Drawing Sheets

(56) References Cited

U.S. PATENT DOCUMENTS

| | | | | |
|---|---|---|---|---|
| 5,505,254 | A * | 4/1996 | Chiba | F28D 1/05341 165/148 |
| 6,283,159 | B1 * | 9/2001 | Tada | F16L 9/18 138/111 |
| 8,701,419 | B2 * | 4/2014 | Hughes | F23R 3/286 60/772 |
| 9,033,699 | B2 * | 5/2015 | Stoia | F23R 3/286 431/144 |
| 9,534,787 | B2 * | 1/2017 | Westmoreland | F23R 3/10 |
| 9,587,823 | B2 * | 3/2017 | Horn | F23D 14/58 |
| 9,625,157 | B2 * | 4/2017 | Melton | F23R 3/286 |
| 2010/0248174 | A1 | 9/2010 | Horn et al. | |
| 2013/0122438 | A1 * | 5/2013 | Stoia | F23R 3/286 431/144 |
| 2013/0213051 | A1 | 8/2013 | Westmoreland, III et al. | |
| 2014/0083110 | A1 | 3/2014 | Stewart et al. | |
| 2015/0226435 | A1 * | 8/2015 | Melton | F23R 3/286 60/737 |
| 2017/0058780 | A1 * | 3/2017 | Kim | F02C 9/18 |

* cited by examiner

BUNDLED TUBE FUEL NOZZLE WITH VIBRATION DAMPING

FIELD OF THE TECHNOLOGY

The present invention generally involves a bundled tube fuel nozzle for a gas turbine combustor. More specifically, the invention relates to a bundled tube fuel nozzle with vibration damping.

BACKGROUND

Particular combustion systems for gas turbine engines utilize combustors having bundled tube type fuel nozzles for premixing a gaseous fuel with a compressed air upstream from a combustion zone. A bundled tube fuel nozzle generally includes multiple tubes that extend through a fuel plenum which is at least partially defined between a forward plate, an intermediate plate and an outer sleeve. Compressed air flows into an inlet portion of each tube. Fuel from the fuel plenum is injected into each tube where it premixes with the compressed before it is routed into the combustion zone.

A portion of each tube may be rigidly connected to the intermediate plate while a downstream end or tip portion is unsupported, thereby creating a cantilevered tube. The downstream end or tip portion of each tube extends through a corresponding tube opening defined in an aft plate which is axially spaced from the intermediate plate and positioned proximate to the combustion chamber. A circumferentially continuous radial gap is defined between an outer surface of each tube at its tip portion and the corresponding tube opening in the aft plate to allow for a cooling fluid such as compressed air to flow around the tube towards the combustion chamber, thereby cooling the tip portion. During operation, the tip portion of each tube may vibrate causing potentially resulting in undesirable wear between the individual tubes and the aft plate.

BRIEF DESCRIPTION OF THE TECHNOLOGY

Aspects and advantages are set forth below in the following description, or may be obvious from the description, or may be learned through practice.

One embodiment of the present disclosure is a bundled tube fuel nozzle. The bundled tube fuel nozzle includes a forward plate, an intermediate plate, an aft plate and an outer sleeve. The forward plate, the intermediate plate and the outer sleeve define a fuel plenum therebetween. An aft plate is axially spaced from the intermediate plate and the intermediate plate, the aft plate and the outer sleeve define a cooling air plenum therebetween. A plurality of tubes extends through the forward plate, the fuel plenum, the intermediate plate, the cooling air plenum and the aft plate. Each tube of the plurality of tubes extends through a respective tube opening of a plurality of tube openings defined by the aft plate. A radial gap is defined between an outer surface of each tube and an inner surface of the respective tube opening. The plurality of tubes comprises at least one tube that is radially loaded against the inner surface of the respective tube opening.

Another embodiment of the present disclosure is a combustor. The combustor includes an end cover coupled to an outer casing and a bundled tube fuel nozzle disposed within the outer casing and coupled to the end cover via one or more fluid conduits. The bundled tube fuel nozzle includes a forward plate, an intermediate plate, an aft plate and an outer sleeve. The forward plate, the intermediate plate and the outer sleeve define a fuel plenum therebetween. An aft plate is axially spaced from the intermediate plate and the intermediate plate, the aft plate and the outer sleeve define a cooling air plenum therebetween. A plurality of tubes extends through the forward plate, the fuel plenum, the intermediate plate, the cooling air plenum and the aft plate. Each tube of the plurality of tubes extends through a respective tube opening of a plurality of tube openings defined by the aft plate. A radial gap is defined between an outer surface of each tube and an inner surface of the respective tube opening. The plurality of tubes comprises at least one tube that is radially loaded against the inner surface of the respective tube opening.

Another embodiment includes a gas turbine. The gas turbine includes a compressor, a combustor downstream from the compressor and a turbine disposed downstream form the compressor. The combustor includes an end cover that is coupled to an outer casing and a bundled tube fuel nozzle disposed within the outer casing and coupled to the end cover via one or more fluid conduits. The bundled tube fuel nozzle includes a forward plate, an intermediate plate, an aft plate and an outer sleeve. The forward plate, the intermediate plate and the outer sleeve define a fuel plenum therebetween. An aft plate is axially spaced from the intermediate plate and the intermediate plate, the aft plate and the outer sleeve define a cooling air plenum therebetween. A plurality of tubes extends through the forward plate, the fuel plenum, the intermediate plate, the cooling air plenum and the aft plate. Each tube of the plurality of tubes extends through a respective tube opening of a plurality of tube openings defined by the aft plate. A radial gap is defined between an outer surface of each tube and an inner surface of the respective tube opening. The plurality of tubes comprises at least one tube that is radially loaded against the inner surface of the respective tube opening.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
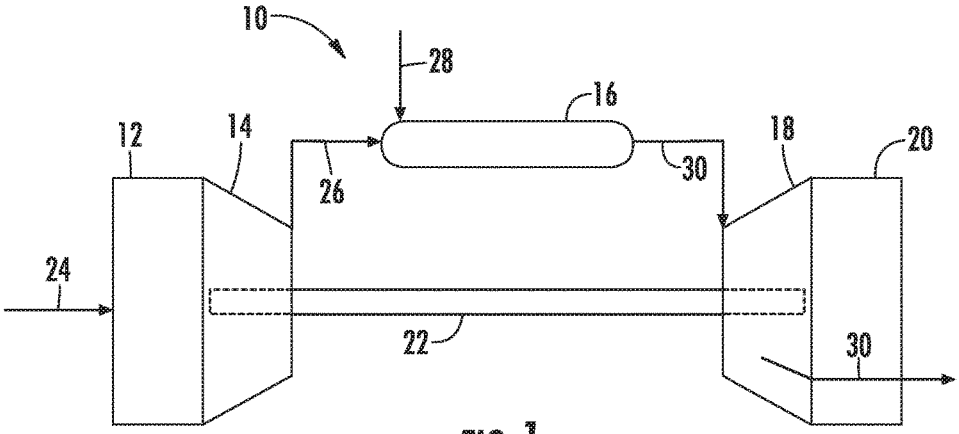
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a bundled tube fuel nozzle for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
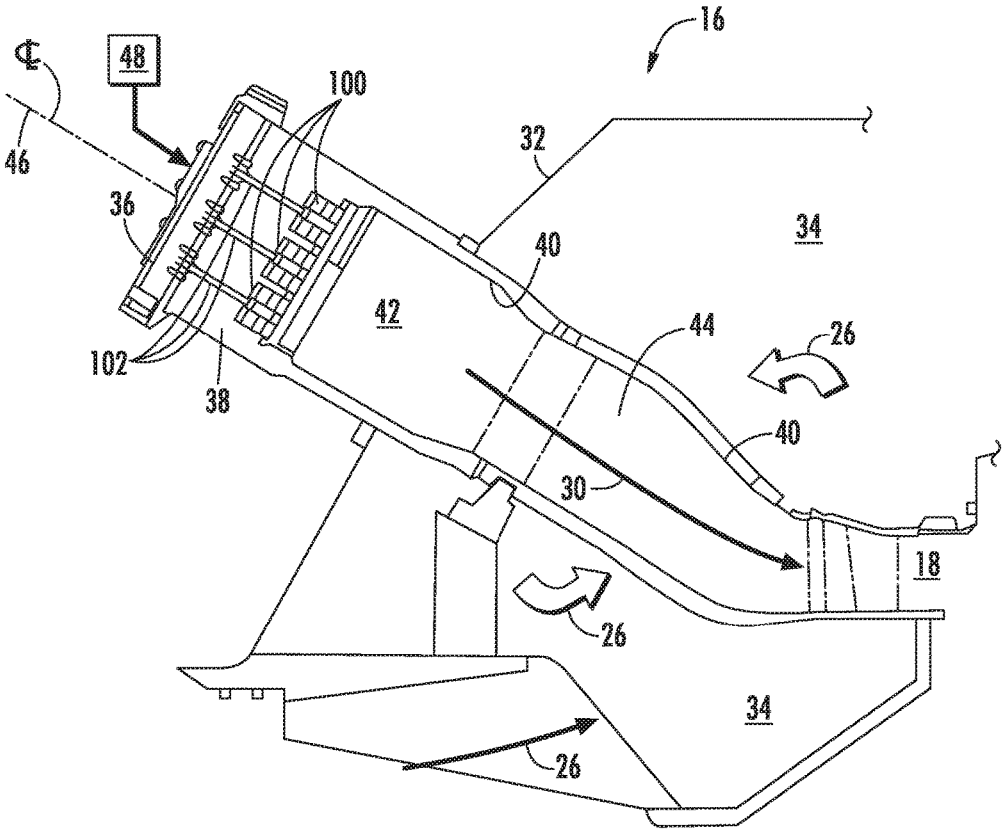
FIG. 2 is a simplified cross-section side view of an exemplary combustor as may incorporate various embodiments of the present disclosure.

As shown in FIG. 2, the combustor 16 may be at least partially surrounded an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 (FIG. 1) so as to receive the compressed air 26 therefrom. An end cover 36 may be coupled to the outer casing 32. In particular embodiments, the outer casing 32 and the end cover 36 may at least partially define a head end volume or portion 38 of the combustor 16.

In particular embodiments, the head end portion 38 is in fluid communication with the high pressure plenum 34 and/or the compressor 14. One or more liners or ducts 40 may at least partially define a combustion chamber or zone 42 for combusting the fuel-air mixture and/or may at least partially define a hot gas path through the combustor as indicated by arrow 44, for directing the combustion gases 30 towards an inlet to the turbine 18.

In various embodiments, the combustor 16 includes at least one bundled tube fuel nozzle 100. As shown in FIG. 2, the bundled tube fuel nozzle 100 is disposed within the outer casing 32 downstream from and/or axially spaced from the end cover 36 with respect to axial centerline 46 of the combustor 16 and upstream from the combustion chamber 42. In particular embodiments, the bundled tube fuel nozzle 100 is in fluid communication with a gas fuel supply 48 via one or more fluid conduits 102. In particular embodiments, the fluid conduit(s) 102 may be fluidly coupled and/or connected at one end to the end cover 36.

Figure 3:
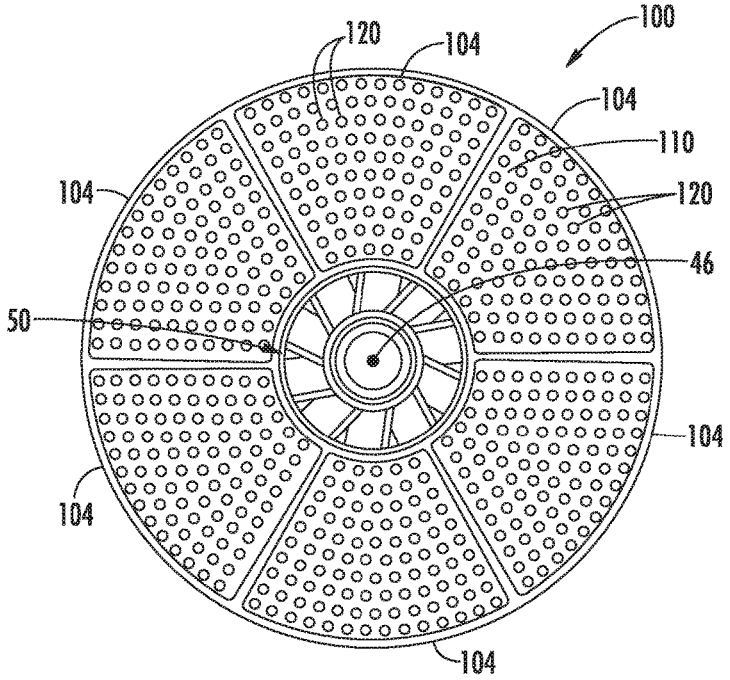
FIG. 3 is an upstream view of an exemplary bundled tube fuel nozzle according to one or more embodiments of the present disclosure.
Figure 4:
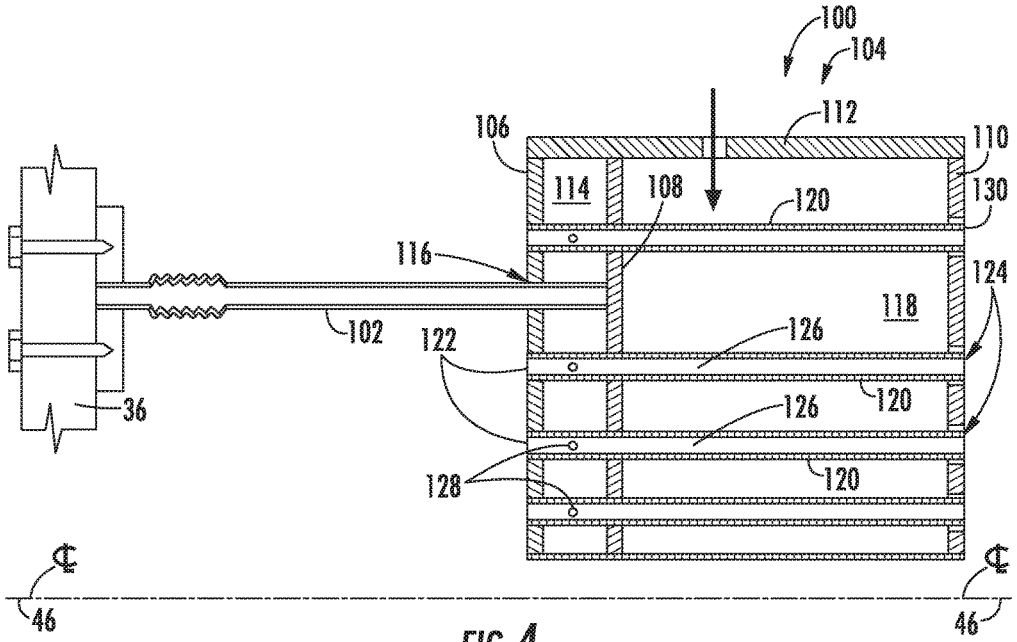
FIG. 4 is a cross sectioned side view of a portion of the bundled tube fuel nozzle as shown in FIG. 3, according to at least one embodiment of the present disclosure.

FIG. 3 provides an upstream view of an exemplary bundled tube fuel nozzle 100 according to at least one embodiment of the present disclosure. FIG. 4 provides a cross sectioned side view of a portion of the bundled tube fuel nozzle 100 as shown in FIG. 3, according to at least one embodiment of the present disclosure. Various embodiments of the combustor 16 may include different arrangements of the bundled tube fuel nozzle 100 and is not limited to any particular arrangement unless otherwise specified in the claims. For example, in particular configurations as illustrated in FIG. 3, the bundled tube fuel nozzle 100 includes multiple wedge shaped bundled tube fuel nozzle assemblies 104 annularly arranged about centerline 46. In particular embodiments, the bundled tube fuel nozzle 100 forms an annulus or fuel nozzle passage about a center fuel nozzle 50.

In at least one embodiment, as shown in FIG. 4, the bundled tube fuel nozzle 100 and/or each bundled tube fuel nozzle assembly 104, includes, in sequential order, a forward plate 106, an intermediate plate 108 axially spaced from the forward plate 106, an aft plate 110 axially spaced from the intermediate plate 108 and an outer shroud or sleeve 112 that extends about an outer perimeter or peripheral edge of the forward plate 106, the intermediate plate 108 and the aft plate 110. In at least one embodiment, the forward plate 106, the intermediate plate 108 and the sleeve 112 at least partially define a fuel plenum 114 within the bundled tube fuel nozzle 100. The forward plate 106 may define an opening 116 to the fuel plenum 114. The opening 116 may be fluidly coupled to the fluid conduit 102. The intermediate plate 108, the aft plate 110 and the sleeve 112 at least partially define a purge air plenum 118 within the bundled tube fuel nozzle 100.

In various embodiments, as shown in FIGS. 3 and 4 collectively, the bundled tube fuel nozzle 100 and/or the bundled tube fuel nozzle assembly 104 includes a plurality of tubes 120 that extends through the forward plate 106, the fuel plenum 114, the intermediate plate 108, the purge air plenum 118 and the aft plate 110. As shown in FIG. 4, each tube 120 includes an inlet 122 defined at or upstream from an upstream side of the forward plate 106 and an outlet 124 defined at or downstream from a downstream or hot side of the aft plate 110. Each tube 120 defines a premix flow passage 126 through the bundled tube fuel nozzle 100 and/or the bundled tube fuel nozzle assembly 104. One or more of the tubes 120 includes at least one fuel injection port 128 which provides for fluid communication between the fuel plenum 114 and the respective premix flow passage 126.

Figure 5:
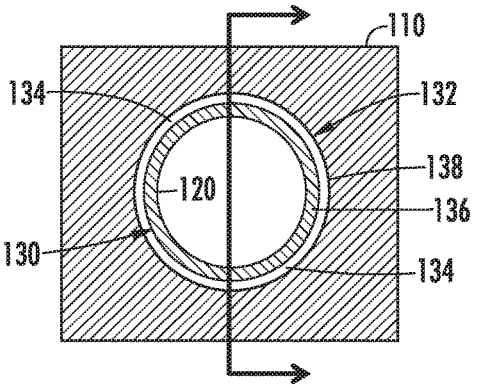
FIG. 5 (PRIOR ART)
FIG. 5 is an enlarged upstream view of a tip portion of an exemplary tube of a plurality of tubes and a portion of an aft plate of an exemplary bundled tube fuel nozzle as known in the art.
Figure 6:
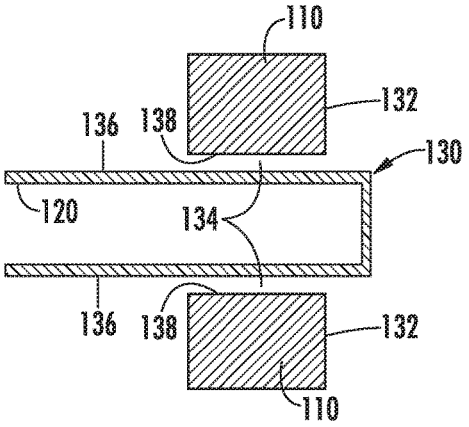
FIG. 6 (PRIOR ART)
FIG. 6 is a cross sectional side view of the tube and the aft plate as taken along section line 6-6 in FIG. 5.

FIG. 5 is an enlarged upstream view of a tip portion 130 of an exemplary tube 120 of the plurality of tubes 120 and a portion of the aft plate 110 as known in the art. FIG. 6 is a cross sectional side view of the tube 120 and the aft plate 110 as taken along section line 6-6 in FIG. 5. As shown in FIGS. 5 and 6, the tip portion 130 of each tube 120 extends at least partially through a respective tube opening 132 defined, at least partially, by the aft plate 110. A radial gap 134 is defined between an outer surface 136 of each tube 120 and an inner surface 138 of the respective tube opening 132. In known bundled tube fuel nozzles as shown in FIG. 5, the radial gap 134 is continuous about the circumference of each tip portion 130 of each tube 120. The radial gap 134 provides or defines a flow path between the outer surface 136 of the tube 120 and the tube opening 132 for channeling a cooling medium, such as compressed air therebetween, thus providing cooling to the tip portion 130 of each tube 120 and/or to the aft plate 110.

During operation, in the known configuration as shown in FIGS. 5 and 6, the cantilevered tubes 120, particularly the tip portion 130 of each tube 120 vibrates due, for example, to combustion dynamics and/or due to mechanical vibrations transferred to the tubes via the gas turbine. In certain instances, the vibrations cause the tubes 120 to move radially within its respective tube opening 132 which may result in contact between the inner surfaces 138 of the tube openings 132 and the tip portions 130 of the tubes 120. This contact may result in undesirable wear on the aft plate 110 and/or on the tubes 120.

FIGS. 7, 8, 9 and 10 provide enlarged upstream views of the tip portion 130 of an exemplary tube 120 of the plurality of tubes 120 and a portion of the aft plate 110 according to various embodiments of the present invention. In various embodiments, as illustrated in FIGS. 7, 8, 9 and 10, the plurality of tubes 120 comprises at least one tube 120 that is radially or spring loaded as indicated by arrow(s) RL against the inner surface 138 of the respective tube opening 132 at one or more contact points CP. The radial load RL may be provided by bending the tube(s) 120 such that the tube(s) 120 contact against the inner surface 138 of the respective tube opening 132. As shown in FIGS. 7, 8, 9 and 10, the radial gap 134 is maintained between a portion of the tube 120 and the tube opening 132.

The tube(s) 120, particularly the tip portion(s) 130, may have circular or non-circular cross sectional shapes. For example, the tube(s) 120 may be circular, oval, triangular or multisided such as a pentagon, hexagon, octagon or any other non-circular shape which allows for at least one contact point CP between the outer surface 136 of the tube(s) 120 and the inner surface 138 of the respective tube opening 132.

Figure 7:
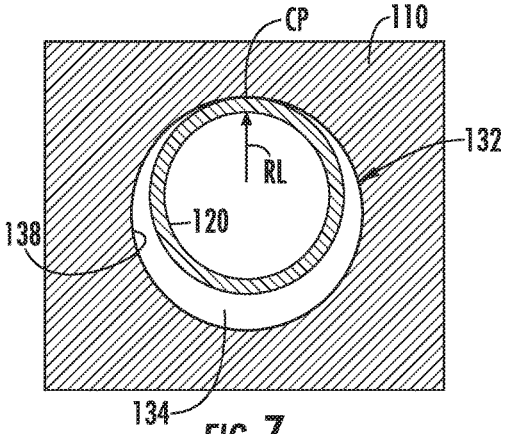
FIG. 7 is an enlarged upstream view of a tip portion of an exemplary tube of a plurality of tubes and a portion of an aft plate of an exemplary bundled tube fuel nozzle according to at least one embodiment of the present invention.
Figure 8:
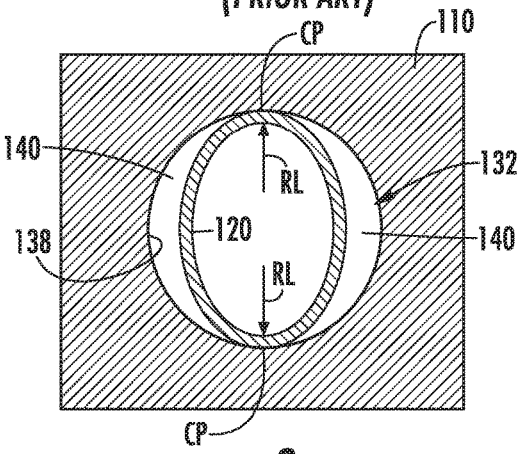
FIG. 8 is an enlarged upstream view of a tip portion of an exemplary tube of a plurality of tubes and a portion of an aft plate of an exemplary bundled tube fuel nozzle according to at least one embodiment of the present invention.
Figure 9:
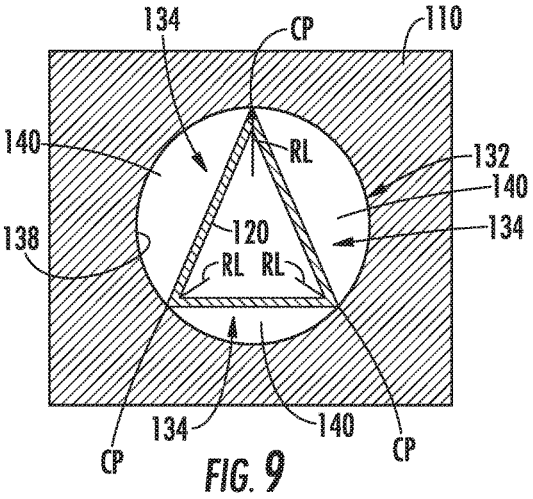
FIG. 9 is an enlarged upstream view of a tip portion of an exemplary tube of a plurality of tubes and a portion of an aft plate of an exemplary bundled tube fuel nozzle according to at least one embodiment of the present invention.
Figure 10:
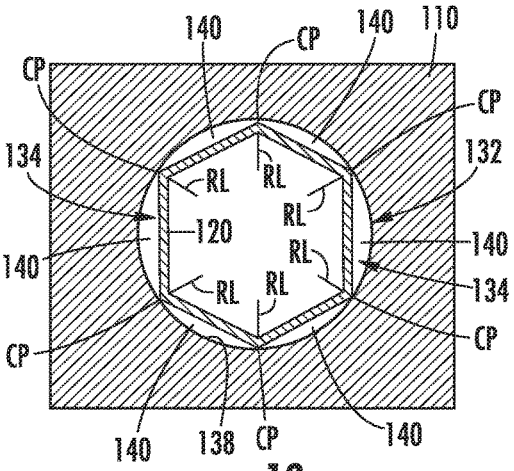
FIG. 10 is an enlarged upstream view of a tip portion of an exemplary tube of a plurality of tubes and a portion of an aft plate of an exemplary bundled tube fuel nozzle according to at least one embodiment of the present invention.

In particular embodiments, as shown in FIG. 7, at least one tube 120 of the plurality of tubes 120 is radially loaded RL against the inner surface 138 of the respective tube opening 132 at one contact point CP along the inner surface 138. In particular embodiments, as shown in FIGS. 8, 9 and 10, at least one tube 120 is radially loaded RL against the inner surface 138 at two or more contact points CP along the inner surface 138. In particular embodiments, one or more of the tubes 120 is radially loaded RL against the inner surface 138 of the respective tube opening 132 at two or more contact points CP along the inner surface 138 and divides the radial gap 134 into two or more gap segments 140 which are fluidly isolated from each other.

The various embodiments illustrated and described herein provide various technical benefits over exiting bundled tube fuel nozzles. For example, the radial loaded tubes reduce tube tip wear thus improving tube life. In addition, the embodiments provided do not require an increase in part count which saves manufacturing costs and time and may reduce high cycle fatigue at the tube/intermediate plate connection.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A bundled tube fuel nozzle, comprising:

a forward plate, an intermediate plate, and an outer sleeve, wherein the forward plate, the intermediate plate and the outer sleeve define a fuel plenum therebetween;

an aft plate axially spaced from the intermediate plate, wherein the intermediate plate, the aft plate, and the outer sleeve define a cooling air plenum therebetween; and a plurality of tubes that extends through the forward plate, the fuel plenum, the intermediate plate, the cooling air plenum and the aft plate, wherein each tube of the plurality of tubes extends through a respective tube opening of a plurality of tube openings defined by the aft plate and wherein a radial gap is defined between an outer surface of each tube and an inner surface of the respective tube opening;

wherein the plurality of tubes comprises at least one tube that is radially loaded against the inner surface of the respective tube opening, the at least one tube comprises a tip portion, and the tip portion of the at least one tube has an oval cross sectional shape.

2. The bundled tube fuel nozzle as in claim 1, wherein the at least one tube is radially loaded against the inner surface at one contact point along the inner surface.

3. The bundled tube fuel nozzle as in claim 1, wherein the at least one tube is radially loaded against the inner surface at two or more contact points along the inner surface.

4. The bundled tube fuel nozzle as in claim 1, wherein the at least one tube is radially loaded against the inner surface at two or more contact points along the inner surface and divides the radial gap into two or more fluidly isolated gap segments.

5. A combustor, comprising:

an end cover coupled to an outer casing;

a bundled tube fuel nozzle disposed within the outer casing and coupled to the end cover via one or more fluid conduits, wherein the bundled tube fuel nozzle comprises:

a forward plate, an intermediate plate, and an outer sleeve, wherein the forward plate, the intermediate plate and the outer sleeve define a fuel plenum therebetween;

an aft plate axially spaced from the intermediate plate, wherein the intermediate plate, the aft plate and the outer sleeve define a cooling air plenum therebetween; and a plurality of tubes that extends through the forward plate, the fuel plenum, the intermediate plate, the cooling air plenum and the aft plate, wherein each tube of the plurality of tubes extends through a respective tube opening of a plurality of tube openings defined by the aft plate and wherein a radial gap is defined between an outer surface of each tube and an inner surface of the respective tube opening;

wherein the plurality of tubes comprises at least one tube that is radially loaded against the inner surface of the respective tube opening, the at least one tube comprises a tip portion, and the tip portion of the at least one tube has an oval cross sectional shape.

6. The combustor as in claim 5, wherein the at least one tube is radially loaded against the inner surface at one contact point along the inner surface.

7. The combustor as in claim 5, wherein the at least one tube is radially loaded against the inner surface at two or more contact points along the inner surface.

8. The combustor as in claim 5, wherein the at least one tube is radially loaded against the inner surface at two or more contact points along the inner surface and divides the radial gap into two or more fluidly isolated gap segments.

9. A gas turbine, comprising:

a compressor, a combustor downstream from the compressor and a turbine disposed downstream form the compressor, the combustor comprising an end cover coupled to an outer casing and a bundled tube fuel nozzle disposed within the outer casing and coupled to the end cover via one or more fluid conduits, wherein the bundled tube fuel nozzle comprises:

a forward plate, an intermediate plate, and an outer sleeve, wherein the forward plate, the intermediate plate and the outer sleeve define a fuel plenum therebetween;

an aft plate axially spaced from the intermediate plate, wherein the intermediate plate, the aft plate and the outer sleeve define a cooling air plenum therebetween; and a plurality of tubes that extends through the forward plate, the fuel plenum, the intermediate plate, the cooling air plenum and the aft plate, wherein each tube of the plurality of tubes extends through a respective tube opening of a plurality of tube openings defined by the aft plate and wherein a radial gap is defined between an outer surface of each tube and an inner surface of the respective tube opening;

wherein the plurality of tubes comprises at least one tube that is radially loaded against the inner surface of the respective tube opening, the at least one tube comprises a tip portion, and the tip portion of the at least one tube has an oval cross sectional shape.

10. The gas turbine of claim 9, wherein the at least one tube is radially loaded against the inner surface at one contact point along the inner surface.

11. The gas turbine of claim 9, wherein the at least one tube is radially loaded against the inner surface at two or more contact points along the inner surface.

12. The gas turbine of claim 9, wherein the at least one tube is radially loaded against the inner surface at two or more contact points along the inner surface and divides the radial gap into two or more fluidly isolated gap segments.

* * * * *